United States Patent [19]

Fee et al.

[11] 4,290,465

[45] Sep. 22, 1981

[54] HAND INSTRUMENT

[75] Inventors: Robert W. Fee; Richard E. TenEyck, both of Wichita; Lloyd T. Smith, Newton, all of Kans.

[73] Assignee: S/V Tool Company, Inc., Newton, Kans.

[21] Appl. No.: 85,815

[22] Filed: Oct. 17, 1979

[51] Int. Cl.[3] ..... B25G 1/00

[52] U.S. Cl. ..... 145/61 R; 145/61 C

[58] Field of Search ..... 145/50 R, 61 C, 61 R, 145/61 A, 61 B, 61 F, 61 H, 61 K, 61 M

[56] References Cited

U.S. PATENT DOCUMENTS

| | | | |
|---|---|---|---|
| 190,459 | 5/1877 | Wilkinson | 145/61 R |
| 264,527 | 9/1882 | Haley | 145/61 C |
| 628,927 | 7/1899 | Ducharme | 145/61 A |
| 1,721,065 | 7/1929 | Bodmer | 145/61 A |
| 1,839,835 | 1/1932 | Cook | 145/61 R |
| 1,888,222 | 11/1932 | Curtis et al. | 145/61 R |
| 2,483,563 | 10/1949 | Rock | 145/61 R |
| 2,871,899 | 2/1959 | Coyle et al. | 145/50 R |
| 3,173,462 | 3/1965 | Koeppel | 145/61 C |
| 3,189,069 | 6/1965 | Stowell | 145/61 R |
| 3,302,673 | 2/1967 | Forsberg | 145/61 R |
| 3,586,080 | 6/1971 | Slany | 145/61 R |

FOREIGN PATENT DOCUMENTS

| | | | |
|---|---|---|---|
| 730385 | 1/1943 | Fed. Rep. of Germany | 145/61 R |

*Primary Examiner*—Stephen G. Kunin
*Assistant Examiner*—J. T. Zatarga
*Attorney, Agent, or Firm*—Schmidt, Johnson, Hovey & Williams

[57] ABSTRACT

A hand instrument, such as a screwdriver, has a connector between the handle and the shank adapted to reduce costs and simplify production procedures as well as provide added strength and aleviate breakage problems. The handle is specially shaped to enhance manipulation and eliminate injury during use.

4 Claims, 7 Drawing Figures

HAND INSTRUMENT

Hand tools generally, unless expensively designed and fabricated, are normally not long-lasting or easily manipulated. The handles oftentimes rotate relative to their shanks or slip entirely therefrom when excessive pressures and torques are applied. They frequently split or break away from the shanks while in use, when subjected to heat, moisture and chemicals and when thrown about carelessly in shops, in toolboxes and at job sites. Not infrequently, because of poor design the handles blister the hands and the bits slip because of difficulty in keeping them in place on the screw, nut or the like being rotated.

These and other deficiencies are eliminated by the tool shown in the drawing wherein.

Figure 2:
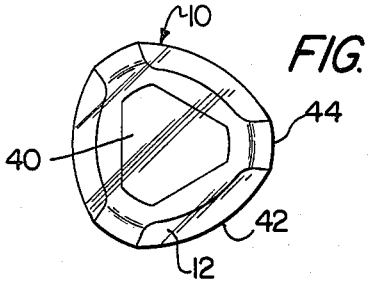
FIG. 2 is an end view therof.
Figure 3:
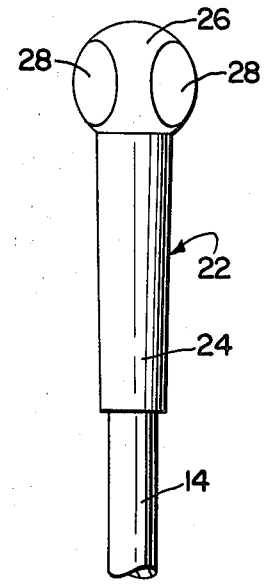
FIG. 3 is a side elevational view of the connector removed from the handle.
Figure 4:
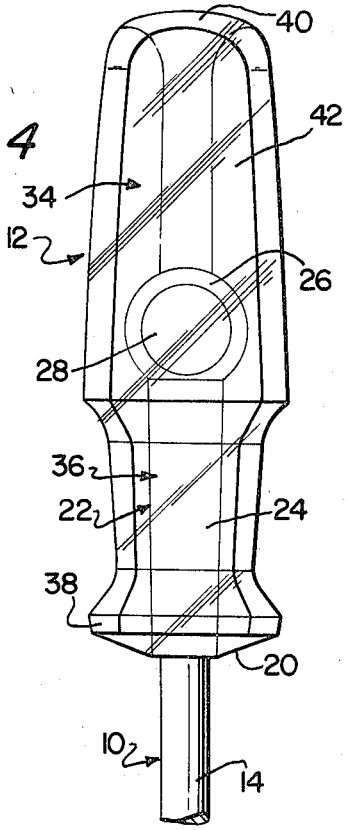
FIG. 4 is a fragmentary view similar to FIG. 1 but rotated 90°.
Figure 1:
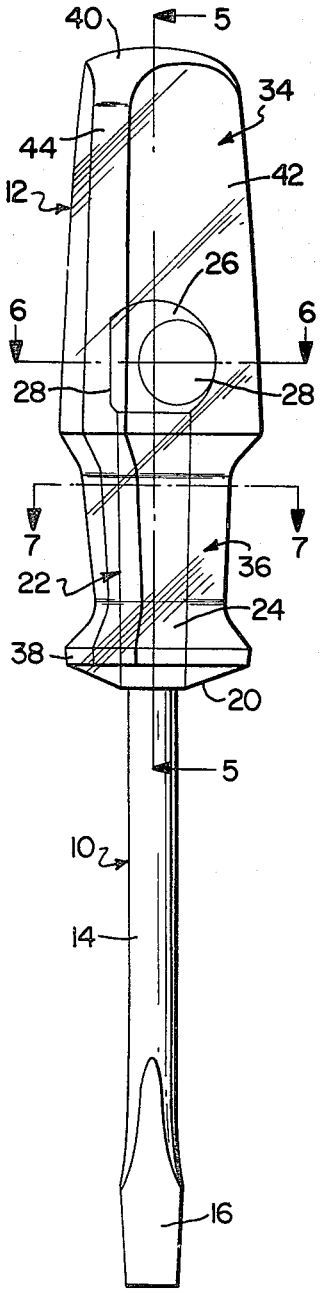
FIG. 1 is a side elevational view of a hand instrument made according to our present invention.
Figure 6:
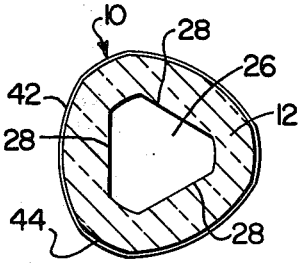
FIG. 6 is a cross-sectional view taken on line 6—6 of FIG. 1.
Figure 7:
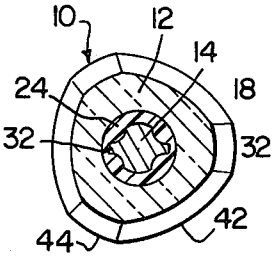
FIG. 7 is a cross-sectional view taken on line 7—7 of FIG. 1.
Figure 5:
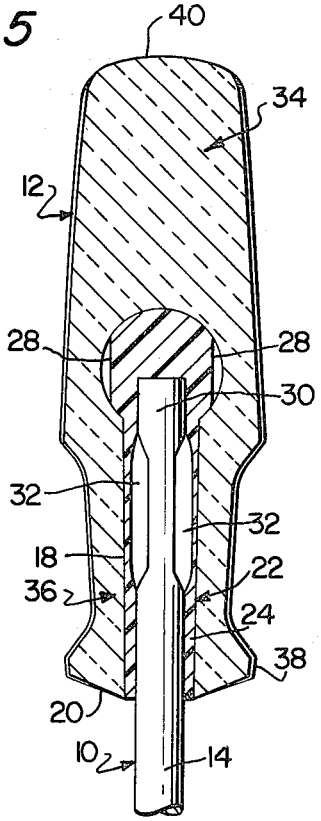
FIG. 5 is a fragmentary cross-sectional view taken on line 5—5 of FIG. 1.

One example of a hand instrument into which the novel improvements of our present invention may be advantageously incorporated is a screwdriver 10 having an elongated handle 12 provided with an elongated, solid shank 14 terminating in a bit 16. The handle 12 has an elongated, longitudinal cavity 18 extending inwardly from an end 20 thereof, and a connector 22, conforming in shape to the cavity 18, is rigidly attached to the handle 12 within the cavity 18, completely filling the latter.

The connector 22 has an elongated, tubular stem 24 provided with a solid boss 26 on its innermost end integral with the stem 24. The external diameter of the stem 24 progressively increases as the boss 26 is approached. The shank 14 is rigidly attached to the connector 22 within the stem 24 and extends outwardly beyond the latter and beyond the end 20 such that the handle 12, the stem 24 and the shank 14 are coaxial.

The boss 26 has an essentially spherical configuration except only for three, equally spaced, outwardly-facing, circular flats 28. The connector 22 is entirely encased within the cavity 18 and the material from which the handle 12 is made tightly engages the entire outer surface of the connector 22. Therefore, the boss 26 and the handle 12 having mating, interengaging, polygonal surfaces for preventing rotation of the handle 12 relative to the connector 22.

The shank 14 has an innermost end 30 extending into the boss 26 and a pair of elongated, longitudinally-extending, diametrically opposed, radial ribs 32 within the stem 24. The shank 14 completely and tightly fills the connector 22. Therefore, the connector 22 tightly engages the entire outer surface of that portion of the shank 14 disposed in the connector 22 to rigidly attach the shank 14 to the connector 22. Thus, the stem 24 and the shank 14 have mating, interengaging, polygonal surfaces for preventing rotation of the connector 22 relative to the shank 14.

In production, with no need for machining, the connector 22 may be moulded around the shank 14 whereupon the handle 12 may, in turn, be moulded around the connector 22, with the materials for the handle 12 and for the connector 22 desireably chosen from suitable plastics or other insulating substances having good resistance to the flow of electricity, high tensile strength, capability of withstanding high torsional loads and sufficiently strong to preclude breakage or damage resulting from blows and other violent treatment, as well as deterioration when subjected to various chemicals.

The handle 12, in addition to the foregoing, is characterized by an elongated, main section 34, an elongated, shorter, secondary section 36 and a flange 38 thereround, adjacent the end 20 and remote from a domed end 40. The section 34 has three, identical, elongated, longitudinally-extending, transversely convex faces 42 and three, identical, elongated, longitudinally-extending, transversely convex, narrower faces 44 alternating with the faces 42. Whereas the faces 42 gradually decrease in width as the end 40 is approached, the faces 44 are of generally uniform width throughout their entire lengths. The faces 42 and 44 are for the most part, longitudinally straight and have rather straight, well-defined lines of merger therebetween. However, the faces 44 especially, terminate in a well-rounded merger with the end 40, and the faces 42 have arcuate transverse lines of merger with the end 40.

The section 36 is identical with the section 34, insofar as facial configuration is concerned, and its wide and narrow faces merge smoothly into the corresponding faces 42 and 44. Moreover, the flange 38 is likewise provided with both long and short edges at its periphery which merge smoothly into the corresponding wide and narrow faces of the section 36, as well as into the slightly domed-shaped end 20.

The transverse, cross-sectional area of the section 34 progressively decreases as the end 40 is approached, whereas the transverse, cross-sectional area of the section 36 progressively decreases as the flange 38 is approached such that the sections 34 and 36 taper in opposite directions. Thus, the maximum transverse, cross-sectional area of the section 36 is appreciably less than that of the section 34. But the maximum distance across the handle 12 at the flange 38 is not appreciably less than the maximum distance across the handle 12 at the zone of merger between the sections 34 and 36.

Therefore, the handle 12 has an exceptionally good "feel" in that it has a perfect fit into the palm of the hand as the thumb and forefinger engage within the section 36. This makes possible an excellent grip on the handle 12 such that slippage in the hand is reduced to a minimum as torque is applied to the tool 10. Moreover, a great amount of pressure can be applied longitudinally of the tool 10, as is required while it is rotated, because the end 20 fits nicely in the palm of the hand. The operator's fingers bear directly on the section 36 along the flange 38, augmenting the ease of applying rotational and longitudinal forces simultaneously onto the handle 12, reducing slippage of the bit from within the kerf of a screw, all without any likelihood of blisters forming in the hand of the user because the faces 42 and 44 and the corresponding faces on the section 36 create an anti-slip lock when gripped in the hand. The tapers of the sections 34 and 36 locate the maximum transverse dimension of the handle 12 precisely where the major force of the hand grip is applied. It is also important that the boss 26 be located within the section 34 adjacent the maximum cross-sectional area of the handle 12, i.e. near the zone of merger between the sections 34 and 36 rather than within the section 36. On the other hand, the stem 24 extends along the section 36.

The tool 10 is also resistant to damage from hammering on the end 40 inasmuch as such forces are transmitted to the bit 16 from the section 34 directly to the boss 26 and to the end 30 such that the shank 14 does not inbed itself deeper into the handle 12 toward the end 40, and the stem 24 reinforces the handle 12 at its narrowest zone along the section 36.

The handle 12 may also be made transparent, as shown, such as to permit the connector 22 to be seen whether or not the latter is also transparent. This, in turn, permits the flats 28 to be used for displaying trademarks and other indicia such as identification of the type or size of tool 10 to which the handle 12 has been adapted.

We claim:

1. In a hand instrument:

an elongated handle having a pair of opposed ends, there being an elongated cavity in said handle disposed longitudinally thereof and extending inwardly from one of said ends;

an elongated connector conforming in shape to the cavity, said connector being encased within and completely filling said cavity, said handle tightly engaging the entire outer surface of the connector therearound to rigidly attach the connector to the handle, said connector having an elongated, tubular stem, said stem being provided with an innermost end having a solid, essentially spherical boss integral with the stem for holding the connector against inward movement relative to the handle toward the opposite end of the latter, said boss having a plurality of outwardly facing, circular, flat surfaces, spaced equally therearound for holding the handle and the connector against relative rotation; and an elongated, solid shank within the connector and extending outwardly therefrom beyond said one end of the handle, said connector tightly engaging the entire outer surface of that portion of the shank disposed in the connector to rigidly attach the shank to the connector, said shank having an innermost end extending into the boss for holding the shank against inward movement relative to the connector toward said opposite end of the handle, said shank having a pair of elongated, diametrically opposed, radial ribs within the connector adjacent the boss and extending longitudinally of the shank for holding the shank and the connector against relative rotation, the handle, the connector and the shank being coaxial.

2. The invention of claim 1, said handle having a number of identical, elongated, outermost, relatively wide, continuous, transversely convex faces and a number of identical, elongated, continuous, outermost, transversely convex narrower faces, said faces extending longitudinally of the handle from said one end thereof to said opposite end thereof, the narrow faces alternating with the wide faces and the latter gradually decreasing in width as said opposite end of the handle is approached.

3. The invention of claim 2, said handle having an elongated main section tapering inwardly toward said opposite end of the handle, a flange therearound adjacent said one end of the handle and an elongated, shorter, secondary section between the flange and the main section tapering inwardly toward the flange, the maximum cross-sectional area of the secondary section being appreciably less than that of the main section.

4. The invention of claim 3, said boss being within the main section of the handle, said stem extending along the secondary section of the handle and having its external diameter progressively increasing as the boss is approached.

* * * * *